US005960492A

United States Patent [19]

Byrne

[11] Patent Number: 5,960,492

[45] Date of Patent: Oct. 5, 1999

[54] SLEEPING BAG EXTENSION

[76] Inventor: Tracey Ann Byrne, 803 - 24th Ave. E., Seattle, Wash. 98112

[21] Appl. No.: 09/049,603

[22] Filed: Mar. 27, 1998

[51] Int. Cl.[6] ..... A47G 9/06

[52] U.S. Cl. ..... 5/413 R; 2/69.5

[58] Field of Search ..... 5/413 R, 482, 5/496; 2/69.5

[56] References Cited

U.S. PATENT DOCUMENTS

| | | | |
|---|---|---|---|
| 2,656,844 | 2/1953 | Kreuzer | 5/413 R |
| 2,757,390 | 8/1956 | Miller | 5/413 R |
| 3,510,889 | 5/1970 | Peterson | 5/413 R |
| 3,584,323 | 6/1971 | Worley | 5/413 R |
| 4,183,111 | 1/1980 | Zahavkochav . | |
| 4,894,878 | 1/1990 | Roach . | |
| 4,989,282 | 2/1991 | Goldstein | 5/413 R |
| 5,005,235 | 4/1991 | Huang | 2/69.5 |
| 5,343,578 | 9/1994 | Kettenhofen | 2/69.5 |
| 5,386,602 | 2/1995 | Krenzler . | |
| 5,490,294 | 2/1996 | Kramer . | |
| 5,592,691 | 1/1997 | Ronald | 2/69.5 |

*Primary Examiner*—Michael F. Trettel
*Assistant Examiner*—Fredrick Conley
*Attorney, Agent, or Firm*—Christensen O'Connor Johnson and Kindness

[57] ABSTRACT

A sleeping bag extension panel (10) attaches to a sleeping bag (12) that contains a head end (20), a foot end (22), and a longitudinally disposed opening (24) that extends a portion of the longitudinal length of the sleeping bag, from the head end to a transitional connection point. The longitudinal opening of the sleeping bag has first and second opening edges (28) and (30) to which first and second edge fasteners (32) and (34) are attached. The extension panel consists of a head end (40) and a transitional narrow end (42) that are joined by first and second longitudinal edges (44) and (46). The head end of the extension panel is bounded by a top edge (48) that is wider than the transitional narrow end. The longitudinal edges of the extension panel are fitted with first and second edge fasteners (50) and (52) that are selectively securable to the compatible edge fasteners of the sleeping bag thereby enlarging the torso region of the resultant sleeping bag/extension panel assembly so that two individuals can be comfortably accommodated.

16 Claims, 3 Drawing Sheets

SLEEPING BAG EXTENSION

FIELD OF THE INVENTION

The present invention relates to sleeping bags, and more particularly towards a sleeping bag extension that expands the torso region of a sleeping bag to accommodate two users.

BACKGROUND OF THE INVENTION

Sleeping bags have long been used by hikers, campers, and other individuals in need of compact, portable bedding material. A first type of traditional sleeping bag has been of a generally rectangular configuration, and has included a bottom layer and a top layer folded over to form a common edge along one longitudinal side. A zipper is included along the edge to selectively close the longitudinal side and bottom end of the bag. The top edge was usually left open, allowing a users head to protrude.

One desirable characteristic of this above discussed traditional bag, is that this design often allowed two of these bags to be unzipped, unfolded, stacked and then re-zipped together, forming a two person sleeping bag with a single expanded sleeping compartment of uniform width and length. This dual sleeping bag arrangement was often found to be advantageous for couples, as well as allowing for shared body heat between the two individuals.

The majority of more recently produced conventional sleeping bags however, are of what is referred to as a "mummy bag" type design. This design has a shape more fitted to the human body, with an wider torso region that tapers to a narrower leg and foot region. The mummy bag configuration is designed to remove excess space within the bag so that the interior area which has to be heated by the body of the occupant is reduced to a minimum. This design also minimizes sleeping bag weight. This type of sleeping bag design also usually incorporates a zipper extending the length thereof, or that more typically extends only approximately ¾ of the longitudinal length of the bag. Such bags can be zippered together in side by side fashion, to form a common upper torso area but separate leg and foot areas for two users. This design may not be satisfactory for some couples, and does not result in any weight or pack volume reductions for two hikers.

SUMMARY OF THE INVENTION

The present invention teaches a dual-user sleeping bag extension for enlarging the torso region of an elongate sleeping bag. The extension attaches to a sleeping bag that includes a head end, a foot end and a longitudinal opening that has selective fasteners on each edge of the opening. The extension consists of a fabric panel with a head end, a transition end, and extension fasteners that are attached to both of the panel's longitudinal edges and are selectively securable to the fasteners of the sleeping bag opening. Together the fabric extension panel and the sleeping bag cooperatively form a sleeping bag assembly with an expanded head end for accommodating the torsos of two users and a transitioning region that reduces in size to guide the lower legs of both users into the common foot region of the original sleeping bag.

In a preferred embodiment of the present invention, the dual-user sleeping bag extension is configured to form a tapered or approximately triangular-shaped flexible fabric panel containing a wide head end that narrows to a transitional tip. The longitudinal edges of the sleeping bag extension are fitted with zipper segments that are selectively mateable with compatible zipper segments on the edges of the sleeping bag's longitudinal opening. The longitudinal length of the extension panel is less than or equal to, and more preferably less than the longitudinal length of the sleeping bag, and approximately equal to the length of the longitudinal opening of the sleeping bag. The extension panel preferably consists of one or more plys of insulating material sandwiched between inner and outer fabric layers.

A sleeping bag assembly containing a sleeping bag and an extension panel constructed in accordance with the present invention, combines the ability of traditional rectangular sleeping bags to be joined together allowing a dual occupancy double bag, with the thermal capacity and weight benefits received from modem "mummy style" sleeping bags. The present invention extension panel allows tapered or mummy style sleeping bags to be expanded in the head and torso region such that the resulting expanded bag can comfortably accommodate two users, while still utilizing the leg and foot region of the original sleeping bag so that excess space is minimized. This invention not only provides a desirable sleeping arrangement for couples, but also acts to maximize warmth while sleeping, through shared body heat and reduced excess bag space. Further, since the extension panel is smaller than a fill sleeping bag, the total weight to be carried between two people for their sleeping equipment can be significantly reduced as compared to each carrying a separate bag.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
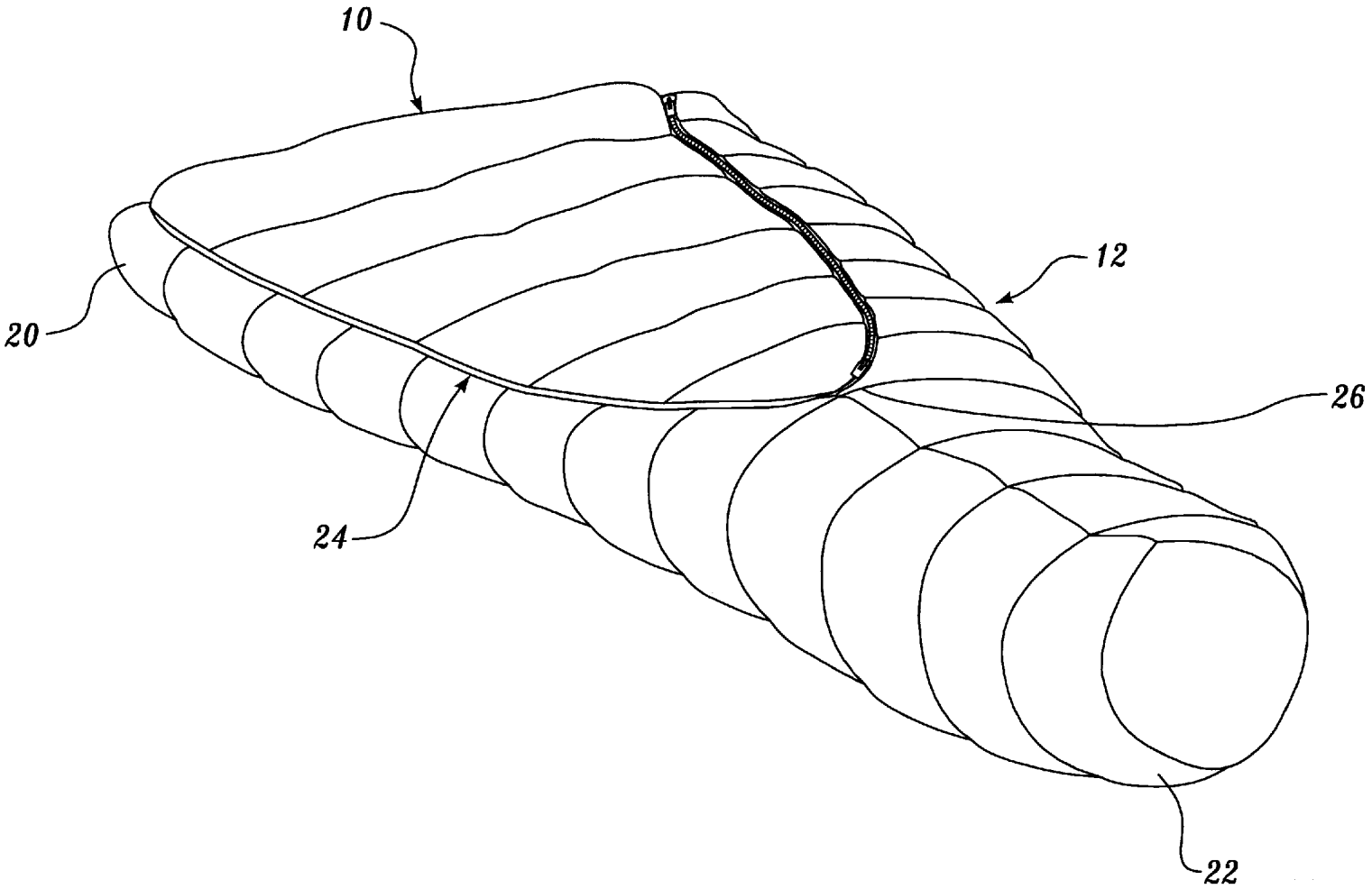
FIG. 1 illustrates an elevated perspective view of a preferred embodiment of the present invention, with the sleeping bag extension shown fastened into a sleeping bag.

FIG. 1 illustrates a preferred embodiment of a sleeping bag extension panel 10 constructed in accordance with the present invention and attached to a sleeping bag 12 for enlarging the torso region of the resultant sleeping bag/extension assembly. The extension panel 10 attaches to a sleeping bag 12 that contains a head end 20, a foot end 22, and a longitudinally disposed opening 24. The opening 24 extends from the head end, along a portion of the longitudinal length of the sleeping bag 12, to a transitional connection point 26 at which the longitudinal opening 24 terminates. The longitudinal opening 24 of the sleeping bag 12 has first and second opening edges 28 and 30 to which first and second selective edge fasteners 32 and 34 are attached. The extension panel 10 consists of a head end 40 and a transitional narrow end 42 between which span first and second longitudinal edges 44 and 46. The head end 40 of the extension panel 10 is bounded by a top edge 48 that is significantly wider than the transitional narrow end 42. The first and second longitudinal edges 44 and 46 of the extension panel 10 are fitted with first and second selective edge fasteners 50 and 52 that extend the length of the extension panel longitudinal edges 44 and 46 and that are selectively securable to the compatible bag edge fasteners 32 and 34 of the sleeping bag 12.

Figure 2:
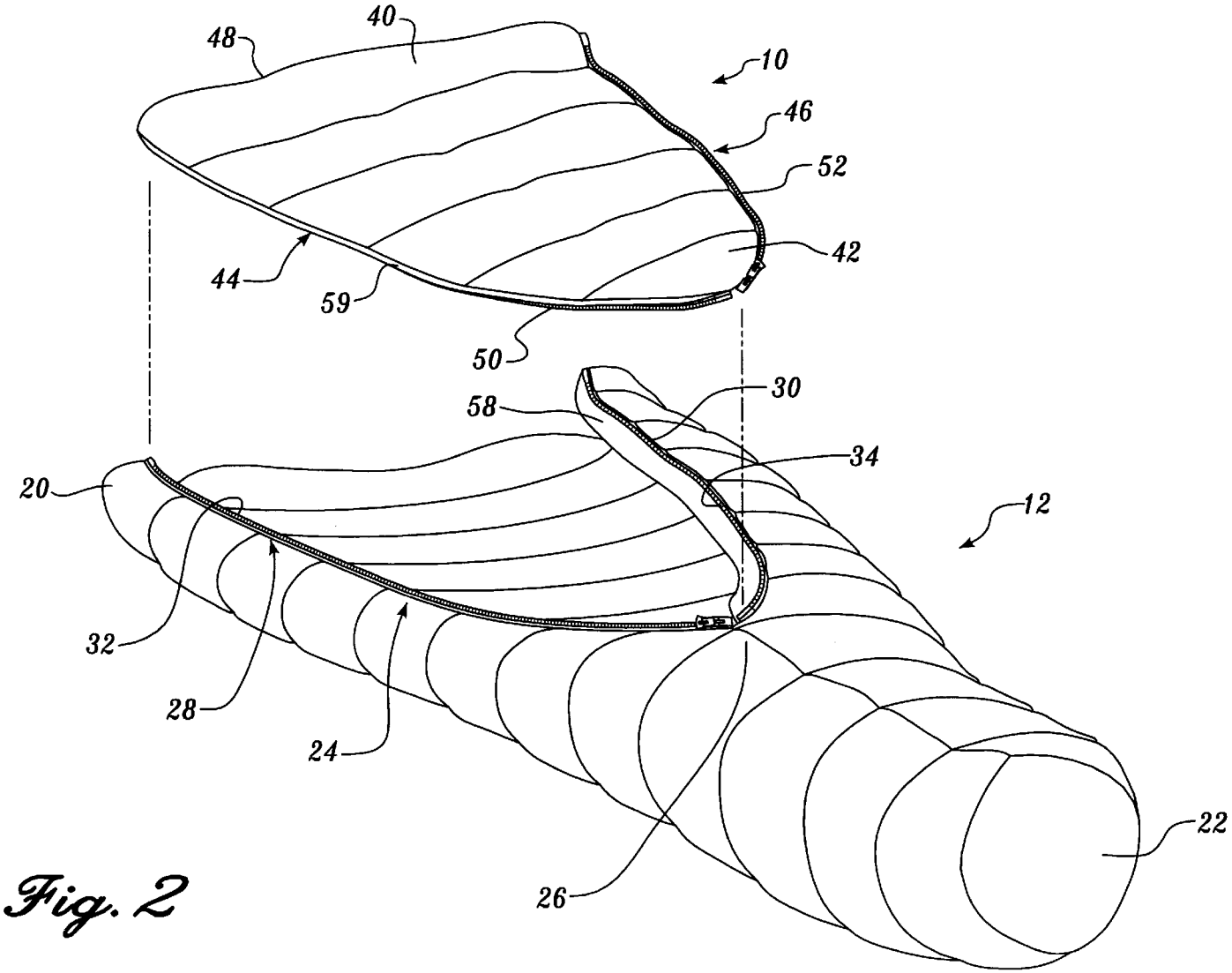
FIG. 2 illustrates an exploded perspective view of the sleeping bag extension of FIG. 1, shown unfastened from a sleeping bag.

The extension panel 10 is constructed of a flexible fabric material and has a tapered configuration. The extension 10 is selectively joined with the sleeping bag 12 to cooperatively form a sleeping bag assembly with an enlarged torso region, which is designed to accommodate the upper bodies of two occupants, and a transitioning region produced by the tapering of the extension panel 10 that reduces the circumferential size of the sleeping bag assembly to guide the lower legs of both occupants into the common foot region of the original sleeping bag. In a preferred embodiment, the top edge 48 of the extension panel 10 is dimensioned to have a width suitable to expand the bag such that two users can lie side by side with shoulders and torsos adjacent to each other. Referring to FIG. 2, the tapering design of the panel 10 may be straight to define a unilateral triangular shape with a slightly rounded tip, or alternately may be more parabolic in configuration. In an alternate embodiment of the present invention (not shown), the extension panel 10 may not continually taper from the head end 40 to the transitional narrower end 42, but instead may have a region where the width of the panel is constant or even increases before eventually narrowing at the transitional end 42, as desired for a close or loose fit to the individuals.

As shown in FIG. 2, the first and second longitudinal edges 44 and 46 intersect or merge together at the transitional narrow end 42. First and second extension edge fasteners 50 and 52 are mounted on the first and second longitudinal edges 44 and 46 and preferably extend the entire longitudinal length of the extension panel 10, from the top edge 48 to the transitional narrow end 42. Referring again to FIG. 1, the first and second extension edge fasteners 50 and 52 are preferably opposing segments of a zipper. Most conventional sleeping bags sold today utilize a Nylon™ polymide zipper sold by YKK. Such YKK™ zippers are suitably used in this practice of the present invention to be compatible with many bags. The edge fasteners 50 and 52 are selectively securable with their compatible counterpart zipper segments that are utilized as the sleeping bag edge fasteners 32 and 34 on the sleeping bags 12. Alternate types of fasteners, such as hook and loop pile strips, or snaps, may alternatively be utilized.

In a preferred embodiment as illustrated in FIG. 2, the top edge 48 of the extension panel 10 does not contain a zipper or other type of fastener device. However, the top edge 48 may be designed with a selectively tightenable drawstring (not shown), such as are commonly utilized along the top edge of the head openings of many sleeping bags 12, or may be contoured as desired to fit the neck region of users. In a preferred embodiment of the present invention, the extension panel 10 is designed to be connectable and compatible with a majority of the mummy bag style sleeping bags 12 currently sold on the market. As such, the extension panel 10 is mounted with zippers for its edge fasteners 50 and 52 that are mateable with the zippers commonly used as sleeping bag edge fasteners 32 and 34 in currently designed sleeping bags 12. However, an alternate embodiment of the present invention could encompass an entire sleeping bag and sleeping bag extension system. In this arrangement, the expandable sleeping bag and corresponding extension panel could utilize a variety or style of fasteners that may not be compatible with other types of bags.

The sleeping bag 12 includes a longitudinal flap 58 along one edge of the opening 24, which overlaps and thereby insulates the closed zipper fastened opening. When the extension panel 10 of the present invention is installed, the flap 58 insulates one closed zipper joint with the extension panel 10. A second longitudinal flap 59 is formed along the opposite longitudinal edge of the panel to overlap-and thereby insulate the second closed zipper joint.

Referring again to FIG. 2, in a preferred embodiment the extension panel 10 has a longitudinal length from its head end 40 to its transitional narrow end 42 that is less than the longitudinal length of a sleeping bag 12 from its head end 20 to its foot end 22. Preferably, the longitudinal length of the extension panel 10 is approximately equal to the length of the longitudinally disposed opening 24 of the sleeping bag 12, i.e., the distance from the head end 20 to the transitional connection point 26. Typically, the length of the longitudinally disposed opening 24 of a mummy-style sleeping bag 12, is approximately three-fourths the longitudinal length of the sleeping bag. Thus, a preferred embodiment extension panel 10 has a length roughly on the order of three-fourths the length of a typical mummy sleeping bag 12. However, an alternate embodiment extension panel could be of a longitudinal length greater than or less than three-quarters of the length of a sleeping bag 12 to fit an alternate sleeping bag with a longitudinal opening of a different length.

Figure 3:
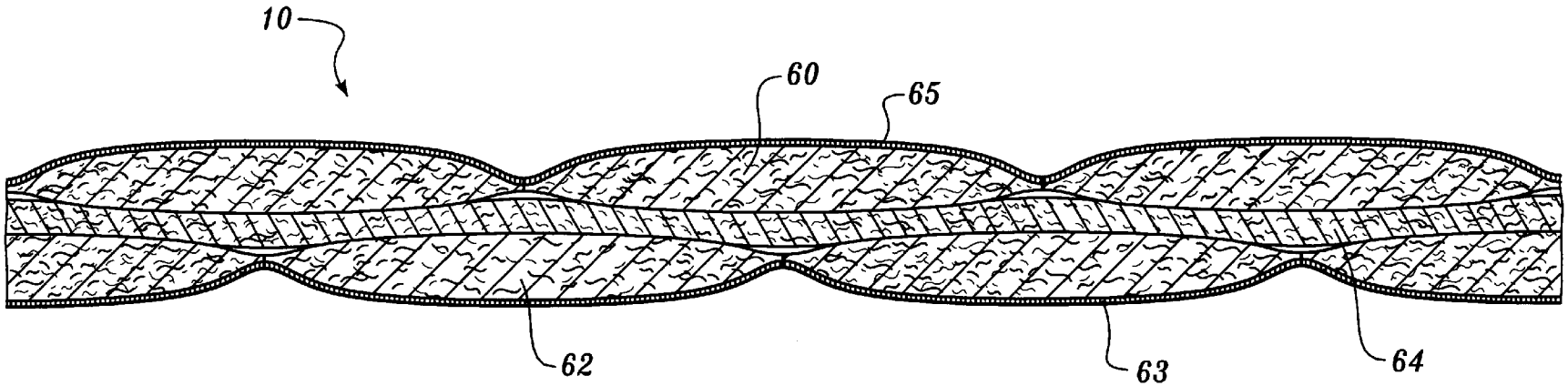
FIG. 3 illustrates a cross-sectional view of the sleeping bag extension of FIG. 1.

As shown in FIG. 3, the extension panel 10 is adapted of a flexible fabric material, preferably similar to that utilized in the sleeping bags 12 to which the extension is designed to be joined. Sleeping bags are usually constructed to be soft and to contain thermal insulative properties. Preferably, the material, or at least the outer layer of the material, is water resistant or water proof. In a preferred embodiment of the present invention intended for cold weather extremes, i.e. an expedition type bag, the extension panel 10 includes multiple layers of insulating material, including an upper outside layer of polyester fiber batting 60 and a lower outside layer of polyester fiber batting 62, that together sandwich a thin highly insulative layer 64, such as a Thinsulite™ layer. As shown in FIG. 3, each batting layer 60 and 62 is joined in an offset stitching arrangement to inner and outer fabric layers 63 and 65, respectively. However, more or fewer layers of insulation may alternatively be utilized, or a variety of alternate materials and joining arrangements may be implemented, as determined for intended climatic conditions, without departing from the scope of the present invention.

The offset stitching technique shown in FIG. 3 provides increased heat insulation properties. The non-alignment of the stitching between the upper and lower batting layers 60 and 62 helps to minimize heat leaks through the stitched region of the material. In this type of stitching arrangement, the upper batting layer 60 is stitched to the outer fabric layer 65, the lower batting layer 62 is stitched to the inner fabric layer 63, and the upper and lower stitched layers are separated by a highly insulative center layer 64 captured therebetween. In alternate embodiments of the present invention, multiple layers of offset stitched layers could be incorporated, as well as a greater or lesser number of highly insulative center layers. Additional alternate embodiments could incorporate this type of offset stitching technique into a variety of other types of apparel and equipment, including but not limited to one-person sleeping bags, coats, pants, parkas, insulative padding, etc.

The extension panel 10 described in the present invention is preferably designed to be utilized with the common mummy-style sleeping bags 12 currently utilized by campers, hikers, and other individuals. The process of attaching the extension panel 10 to the sleeping bag 12 is initiated by first fully unzipping the longitudinal opening 24 of the sleeping bag 12. Typically, this zippered longitudinal opening 24 extends approximately three-fourths the length of the sleeping bag 12. The first and second zipper edge fasteners 32 and 34 are now exposed on either side of the opening 54. The first and second edge fasteners 50 and 52 of the extension panel 10 can then easily be attached to the exposed zipper fastener edges 32 and 34 of the sleeping bag 12. Connection of the extension panel 10 to the sleeping bag 12, and formation of the enlarged torso sleeping bag assembly is then complete. Removal of the extension panel 10 is easily achieved by simply reversing the above-described steps.

Three important considerations in camping and hiking are space minimization, weight minimization, and sleeping bag warmth. The present invention provides benefits in all three of these areas simultaneously. Both the space and weight of sleeping materials required for two people is greatly minimized with this device, since the extension panel 10 is vastly smaller than a full additional sleeping bag 12. Further, the present invention provides synergistic warmth benefits through coupling the heat conservation advantages of the mummy bag design with the warmth benefits derived from shared body heat. Additionally, affectionate couples may find the sleeping arrangement provided by this device to be more desirable than the options provided in the prior art.

The present invention has been described in relation to a preferred embodiment and alternate embodiments. One of ordinary sill after reading the foregoing specifications, may be able to effect various other changes, alterations, and substitutions or equivalents without departing from the concepts disclosed. It is therefore intended that the scope of the Letters Patent granted hereon be limited only by the definitions contained in the intended claims as equivalents thereof.

The embodiments of the invention in which an exclusive property or privilege is claimed are defined as follows:

1. A dual-user extension/sleeping bag system for expanding the transverse width of an elongate sleeping bag portion of the system, the extension/sleeping bag system comprising:

an elongate sleeping bag defining a head end, a foot end and a longitudinal opening defined by first and second longitudinal edges carrying mating first and second selective fasteners;

a fabric panel defining first and second longitudinal edges;

a first extension fastener carried on the first edge of the fabric panel and selectively securable to the first fastener of the sleeping bag; and a second extension fastener carried on the second edge of the fabric panel and selectively securable to the second fastener of the sleeping bag, the fabric panel being formed to cooperatively define with the sleeping bag, an extended head end having an expanded transverse width that is configured to accommodate the torsos of two users and having a transitioning region that reduces in transverse width to guide the lower legs of both users into the foot end of the sleeping bag.

2. The dual-user sleeping bag extension/sleeping bag system of claim 1, wherein the fabric panel is tapered in shape, having a wide head end of increased transverse width and a narrow transition end of reduced transverse width, the extension fastening to the sleeping bag, such that the wide head end of extension secures adjacent to and expands the transverse width of the head end of the sleeping bag, and the narrow transition end connects to a point on the sleeping bag, between the head end and the foot end.

3. The dual-user sleeping bag extension/sleeping bag system of claim 1, wherein the fabric panel is triangular-shaped, having a base portion of an expanded transverse width and an opposite vertex, the extension fastening to the sleeping bag, such that the base portion of the triangle secures adjacent to and expands the transverse width of the head end of the sleeping bag, and the vertex fastens to a point on the sleeping bag, between the head end and the foot end.

4. The dual-user sleeping bag extension/sleeping bag system of claim 1, wherein the fabric panel is configured to define an enlarged head end having an expanded transverse width and a smaller transition end having a narrower transverse width, the extension fastening to the sleeping bag to which the extension is attached, such that the enlarged head end of extension secures adjacent to and expands the transverse width of the head end of the sleeping bag, and the smaller transition end connects to a point on the sleeping bag, between the head end and the foot end.

5. The dual-user sleeping bag extension/sleeping bag system of claim 1, wherein the fabric panel is pie section shaped, having a broad outer rim of an expanded transverse width and an opposite vertex, the extension fastening to the sleeping bag, such that the broad outer rim of the pie section secures adjacent to and expands the transverse width of a head end of the sleeping bag, and the vertex fastens to a point on the sleeping bag, between the head end and the foot end.

6. The dual-user sleeping bag extension/sleeping bag system of claim 1, further comprising a longitudinal flap formed along one of the longitudinal edges of the panel to insulate the corresponding extension fastener.

7. The dual-user sleeping bag extension/sleeping bag system of claim 1, wherein the fasteners on the panel and the sleeping bag comprise zippers.

8. The dual-user sleeping bag extension/sleeping bag system of claim 1, wherein the length of the extension panel is less than the longitudinal distance from the head end to the foot end of the sleeping bag.

9. The dual-user sleeping bag extension/sleeping bag system of claim 8, wherein the length of the longitudinal opening in the sleeping bag is less than the longitudinal length of the sleeping bag, and the longitudinal length of the extension panel corresponds to the length of the longitudinal opening in the sleeping bag.

10. The dual-user sleeping bag extension/sleeping bag system of claim 1, wherein the fabric panel comprises a thermal insulative material.

11. The dual-user sleeping bag extension/sleeping bag system of claim 10, wherein the fabric panel comprises multiple plys of insulative material.

12. An extension for expanding the transverse width of an elongate sleeping bag, the sleeping bag defining a head end, a foot end and a longitudinal opening defined by first and second longitudinal edges carrying mating first and second selective fasteners, the extension comprising:

a tapered panel of flexible material defining a head end of wide transverse width and a transition end of narrow transverse width and first and second longitudinal edges therebetween; and first and second extension fasteners carried on the first and second edges of the tapered panel and selectively securable to first and second fasteners, respectively, of a sleeping bag to which the extension is attached, to cooperatively form an expanded transverse width torso compartment, the head end of the tapered panel being secured adjacent a head end of a sleeping bag to which the extension is attached, and the transition end of the tapered panel being secured at a longitudinal disposition between a head and a foot end of a sleeping bag to which the extension is attached.

13. An extension for expanding the transverse width of an elongate sleeping bag, the sleeping bag defining a head end, a foot end and a longitudinal opening defined by first and second longitudinal edges caring mating first and second selective fasteners, the extension comprising:

triangular-shaped fabric panel defining a transition tip, a head edge having an expanded transverse width, and first and second longitudinal edges extending from the transition tip to the head edge; and first and second extension fasteners carried on the first and second edges of the tapered panel and selectively securable to first and second fasteners, respectively, of a sleeping bag to which the extension is attached, to cooperatively form an expanded transverse width sleeping compartment.

14. An extension for expanding the transverse width of an elongate sleeping bag, the sleeping bag defining a head end, a foot end and a longitudinal opening defined by first and second longitudinal edges carrying mating first and second selective fasteners, the extension comprising:

an elongate fabric panel defining first and second longitudinal edges and having a length less than a length defined between a head end and a foot end of a sleeping bag to which the extension is attached; and first and second extension fasteners carried on the first and second edges of the fabric panel and selectively securable to first and second fasteners, respectively, of a sleeping bag to which the extension is attached, to cooperatively form a sleeping compartment having an expanded transverse width.

15. A dual-user sleeping bag system, comprising:

an elongate single user sleeping bag defining a head end, a foot end and a longitudinal opening defined by first and second longitudinal edges carrying mating first and second selective fasteners;

a fabric extension panel defining first and second longitudinal edges;

a first extension fastener carried on the first edge of the fabric panel and selectively securable to the first fastener of the sleeping bag; and a second extension fastener carried on the second edge of the fabric panel and selectively securable to the second fastener of the sleeping bag, the fabric panel being formed to cooperatively define with the sleeping bag an expanded transverse width head end configured to accommodate the torsos of two users and having a transitioning region that reduces in transverse width to guide the lower legs of both users into the foot end of the sleeping bag.

16. An extension for expanding the transverse width of an elongate sleeping bag, the sleeping bag defining a head end, a foot end and a longitudinal opening defined by first and second longitudinal edges carrying mating first and second selective fasteners, the extension comprising:

an elongate fabric panel defining first and second longitudinal edges which carry first and second extension fasteners that are selectively securable to the selective fasteners of a sleeping bag to which the extension is attached, the panel having a transverse width defined between the edges of the panel less than a transverse width defined between the edges of a sleeping bag to which the extension is attached, the panel being configured to cooperatively form an expanded transverse width sleeping compartment.

* * * * *

UNITED STATES PATENT AND TRADEMARK OFFICE

CERTIFICATE OF CORRECTION

PATENT NO. : 5,960,492
DATED : October 5, 1999
INVENTOR(S) : T.A. Byrne

It is certified that error appears in the above-identified patent and that said Letters Patent is hereby corrected as shown below:

| COLUMN | LINE | |
|---|---|---|
| Pg. 1, col. 1 | Refs. Cited (U.S., Item 1) | "2/1953" should read --10/1953-- |

Signed and Sealed this

Tenth Day of October, 2000

*Attest:*

*Attesting Officer*

Q. TODD DICKINSON

*Director of Patents and Trademarks*